US005244071A

United States Patent [19]

Lobl

[11] Patent Number: 5,244,071

[45] Date of Patent: Sep. 14, 1993

[54] MECHANICAL VENDING MACHINE

[75] Inventor: Naftali Lobl, Forest Hills, N.Y.

[73] Assignee: Mark M. Lobl, N. Miami Beach, Fla.

[21] Appl. No.: 717,363

[22] Filed: Jun. 20, 1991

[51] Int. Cl.[5] ..... G07F 11/10

[52] U.S. Cl. ..... 194/342; 226/232

[58] Field of Search ..... 194/293, 294, 295, 298, 194/299, 300, 342; 221/20, 227, 232, 245

[56] References Cited

U.S. PATENT DOCUMENTS 907,449 12/1908 Bock ..... 194/298
1,240,717 9/1917 Holt ..... 194/294
1,442,078 1/1923 Laraway ..... 194/295
1,672,409 6/1928 Giles ..... 194/294
2,363,426 11/1944 Koehler ..... 194/295
2,475,999 7/1949 Sparagano ..... 221/227

*Primary Examiner*—F. J. Bartuska
*Attorney, Agent, or Firm*—Abdallah & Muckolroy

[57] ABSTRACT

A mechanical vending machine utilizing the coin as part of the dispensing mechanism. A coin is inserted into the vending machine and directed to engage the desired product in a manner to release the product from a stored position in the vending machine. The coin after releasing the product is collected in a coin box.

8 Claims, 6 Drawing Sheets

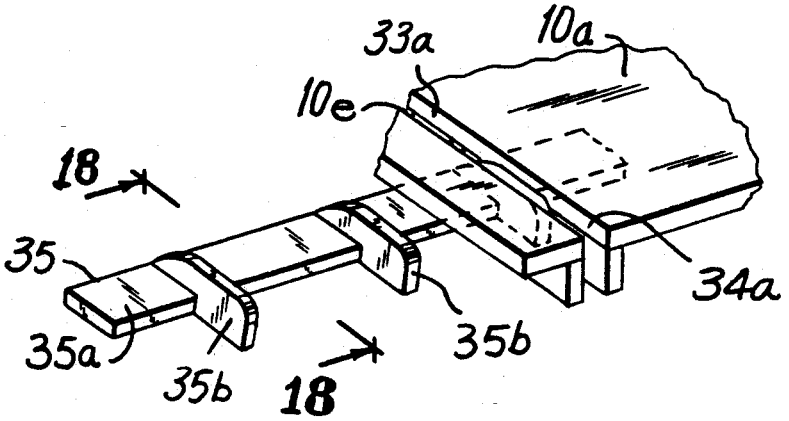
FIG. 17
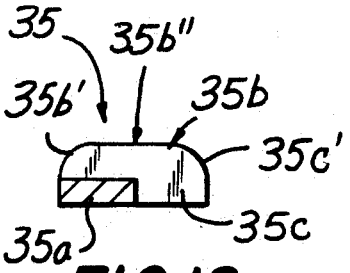
FIG. 18
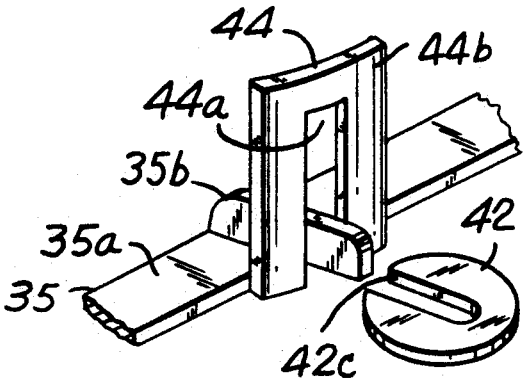
FIG. 19
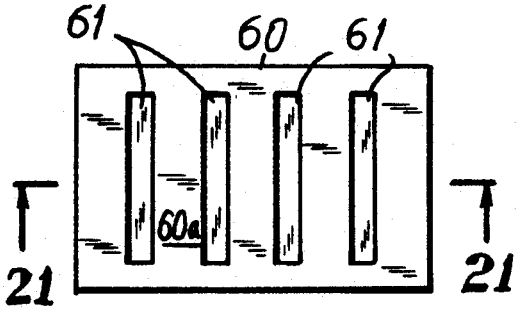
FIG. 20
FIG. 21
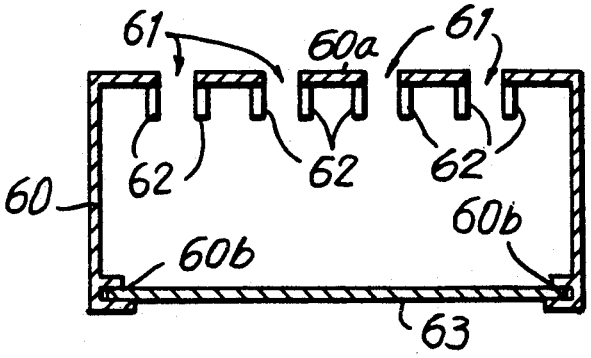

MECHANICAL VENDING MACHINE

BACKGROUND OF THE INVENTION

The present invention generally relates to vending machines. More specifically, the present invention relates to a mechanical vending machine wherein a coin is utilized as part of the product dispensing mechanism.

Mechanical vending machines generally operate by inserting a coin to activate a dispensing mechanism for selective release of a product. The dispensing mechanism operates independently of the inserted coin once it is activated. To the Applicant's knowledge no vending machine in the prior art discloses a product dispensing mechanism which utilizes the inserted coin to release the selected product.

SUMMARY OF THE INVENTION

The present invention is a mechanical vending machine generally including means to receive a coin, means to release a product from a stored position by bearing engagement of the coin against the product, and means to collect the coin after its use to release the product from the machine. A preferred embodiment of the mechanical vending machine of the present invention includes a product dispensing body, a dispensing platform disposed in the product dispensing body, a product storage column communicating with the product dispensing body, at least one coin mechanism communicating with the product storage column which releases a product from the storage column by bearing engagement of a coin against the product, and a coin box communicating with the coin mechanism to collect coins inserted into the coin mechanism.

The preferred embodiment of the present invention is particularly useful for dispensing hard candy on a stick, such as TOOTSIE ROLL Pop candies. TOOTSIE ROLL Pop candies are a popular product which has been unavailable through mechanical vending machines because of the on-the-stick configuration. Also, due to the inexpensive price of TOOTSIE ROLL Pop candies it is not well-suited for dispensation through electronic vending machines which are generally expensive to operate and can only be placed in limited locations. Thus, an object of the present invention is to provide a mechanical vending machine suitable for dispensing hard candy-on-a-stick.

Another object of this invention is to provide a mechanical vending machine which utilizes an inserted coin as part of the physical dispensing mechanism.

These and other objects and advantages of the present invention will be apparent to those skilled in the art from the following description of preferred embodiments, claims and appended drawings.

BRIEF DESCRIPTION OF THE DRAWINGS

FIG. 17 is a top perspective view of the coin bridge of the present invention.

FIG. 18 is a cross-sectional view taken along line 18—18 of FIG. 17.

FIG. 19 is a top perspective view illustrating the cooperation of the coin bridge, operating coin guide and the product release platform.

FIG. 20 is a top plan view of the coin box of the present invention.

FIG. 21 is a cross-sectional view of the coin box taken along line 21—21 of FIG. 20.

DESCRIPTION OF PREFERRED EMBODIMENTS

Figure 1:
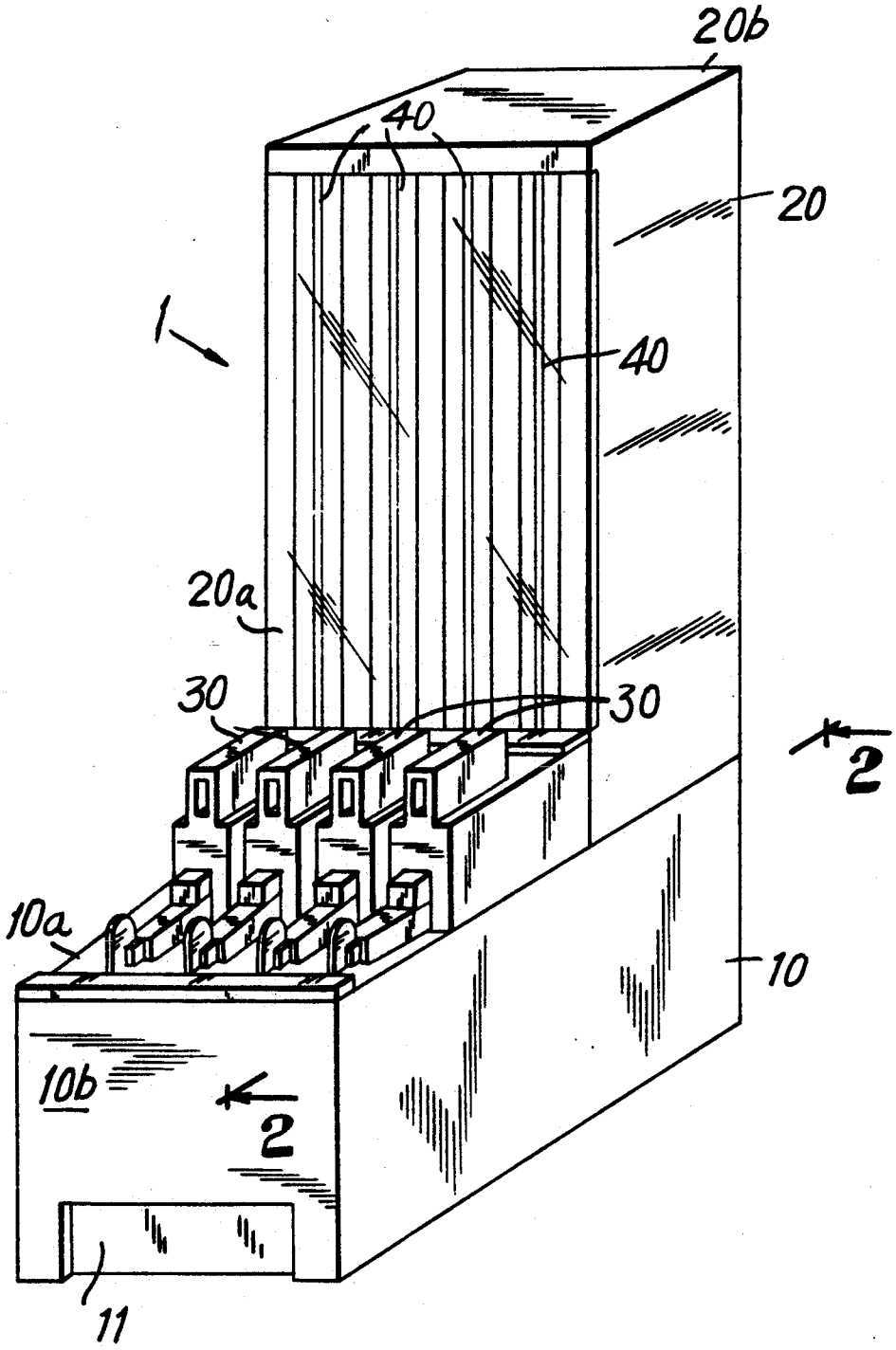
FIG. 1 is a front perspective view of the mechanical vending machine of the present invention.

FIG. 1 illustrates a front perspective view of a first preferred embodiment of the mechanical vending machine 1 of the present invention. First vending machine 1 includes a product dispensing body 10, a product storage column 20 disposed on a rearward portion of the top wall 10*a* of the product dispensing body 10 and a plurality of coin mechanisms 30 disposed on a forward portion of the top wall 10*a* of the product dispensing body 10 and communicating with the product storage column 20. Product dispensing body 10 is preferably a box-shaped member having a product dispensing opening 11 formed in a forward wall 10*b* of the dispensing body 10. As hereinafter described in greater detail product dispensing body 10 further includes a storage column opening formed in the top wall 10*a* thereof below the product storage column 20. Product storage column 20 houses the product to be dispensed and is preferably formed having a transparent forward wall 20*a* so that the product can be viewed. The product is stored in respective product storage tubes 40 which extend vertically substantially from the top wall 20*b* of the product storage column 20 to the top wall 10*a* of the product dispensing body 10. Product storage tubes 40 correspond in number to the coin mechanisms 30, each coin mechanism 30 operating to selectively release a product from a respective product storage tube 40.

Figure 2:
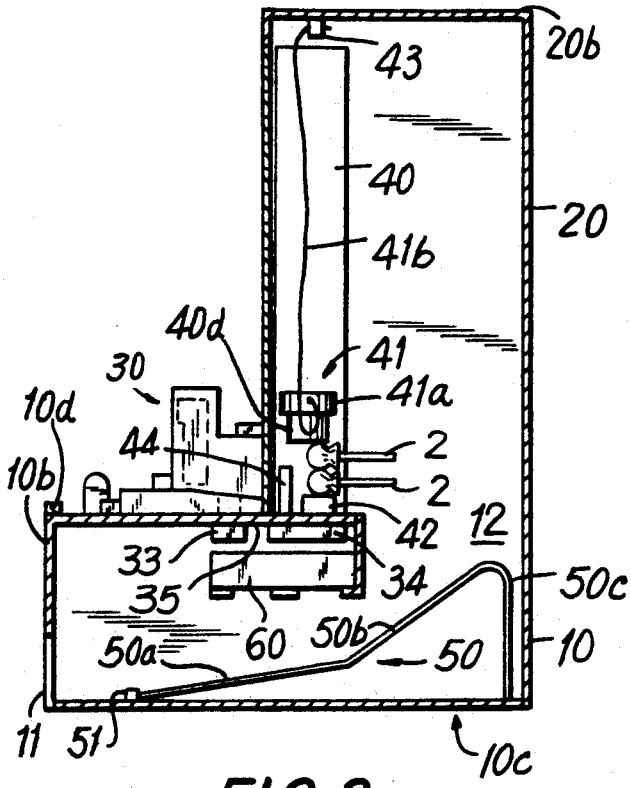
FIG. 2 is a cross-sectional plan view taken along line 2—2 of FIG. 1.

FIG. 2 illustrates in a cross-sectional view taken along line 2—2 of FIG. 1 a side plan view of the interior portions of product dispensing body 10, product storage column 20 and coin mechanism 30. Previously-mentioned storage column opening 12 can be seen to be co-extensive with the product storage column 20 at the rearward portion of product dispensing body 10. A product dispensing slide platform 50 is disposed on the bottom wall 10*c* of product dispensing body 10. Slide platform 50 is preferably selectively removable from said product dispensing body 10. Slide platform 50 is retained proximate to the product dispensing opening 11 formed in the forward wall 10*b* of product dispensing body 10 by means of platform stops 51 fixedly attached at opposing sides to the bottom wall 10*c* of product dispensing body 10. Slide platform 50 comprises a flat, bent plate member having an exit platform section 50*a* disposed at a first angle from bottom wall 10*c*, a central platform section 50*b* integrally formed with an end of exit platform section 50*a* and disposed at a second larger angle from bottom wall 10*c*, and a support platform section 50*c* integrally formed with an end of the central platform section 50*b* and extending vertically therefrom to the bottom wall 10*c* of product dispensing body 10. Slide platform 50 provides means to guide a product released from the product storage column 20 to the product dispensing opening 11 of product dispensing body 10.

Figure 3:
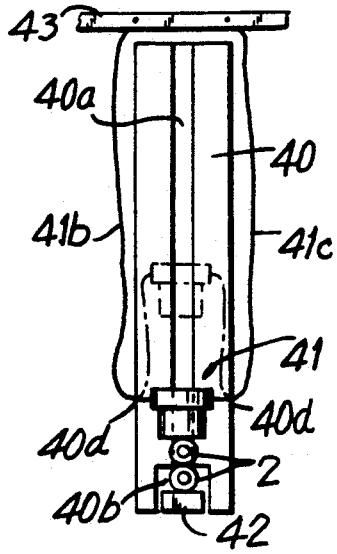
FIG. 3 is a first orthogonal view of the product storage tube as shown in FIG. 2 illustrating the rearward portion of the storage tube.
Figure 4:
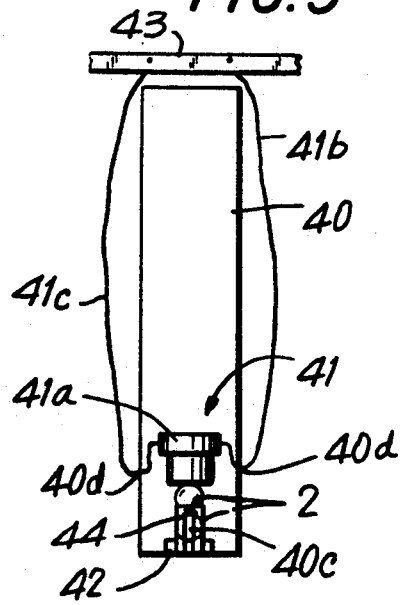
FIG. 4 is a second orthogonal view of the product storage tube as shown in FIG. 2 in the opposite direction illustrating the forward portion of the storage tube.

A plurality of product 2, for example TOOTSIE ROLL pop candies, are stacked in product storage tube 40 and selectively released therefrom as hereinafter described. As can be seen in FIG. 3, a rear plan view of the product storage tube 40 orthogonal to the side view illustrated in FIG. 2, product storage tube 40 includes a tube slit 40*a* formed in the rearward portion of the storage tube 40 extending from the upper portion thereof vertically along its length to a tube product opening 40*b* formed at the lower portion of the storage tube 40. Tube slit 40*a* is provided for extension of the stick 2*a* of the product 2 therethrough and tube product opening 40*b* is provided for selective release of the product 2 from the product storage tube 40. In FIG. 4, a front view of the product storage tube 40 oppositely orthogonal to the side view shown in FIG. 2, product storage tube 40 can be seen to include a tube coin slot 40*c* disposed at a lower portion thereof which receives a coin utilized to release the product 2 from the product storage tube 40 as hereinafter described in greater detail.

Figure 5:
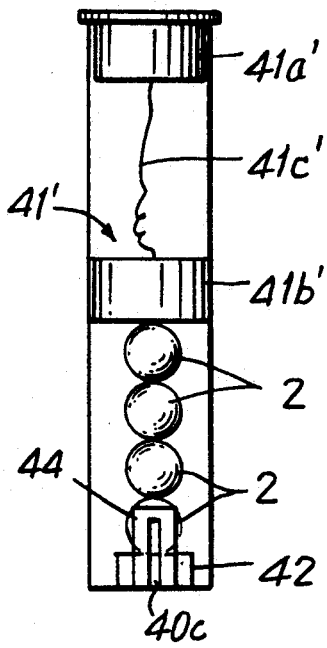
FIG. 5 is a forward plan view of product storage tube illustrating an alternative embodiment of product depression means.

Product 2 is depressed downwardly in product storage tube 40 by product depression means 41 which sequentially position product 2 on a product release platform 42 as a lower positioned product 2 is removed from the storage tube 40. A first product depression means 41 illustrated in FIGS. 2–4 comprises a product depression piston 41*a* slidably disposed in storage tube 40 and a first elastic cord 41*b* and a second elastic cord 41*c* respectively and fixedly attached at one end thereof to opposing sides of product depression piston 41*a*. The respective first and second elastic cords 41*b*, 41*c* extend from the product depression piston 41*a* through respective cord openings 40*d* formed in the product storage tube 40 and are respectively and fixedly attached at the opposite end to a cord support 43. Cord support 43 is fixedly attached to the top wall 20*b* of the product storage column 20. Thereby when the product storage tube 40 is filled with product 2 depression piston 41*a* is disposed higher up within product storage tube 40, as illustrated by the phantom lines in FIG. 3, creating tension in the first and second elastic cords 41*b*, 41*c*. As the lower positioned product 2 is removed from the product storage tube 40 the depression piston 41*a* is pulled downwardly by the respective elastic cords 41*b*, 41*c* thereby positioning the adjacent product 2 on the product release platform 42. A second embodiment of product depression means 41' is illustrated in FIG. 5. Second product depression means 41' comprises a depression stopper 41*a'* fixedly attached to a top portion of product storage tube 40 and a weighting member 41*b'*, preferably a metal member, attached to depression stopper 41*a'* by means of a flaccid cord 41*c'*. Thus, the weight of weighting member 41*b'* causes the plurality of product 2 to move sequentially downward onto product release platform 42 as the lower positioned product 2 is removed.

Figure 6:
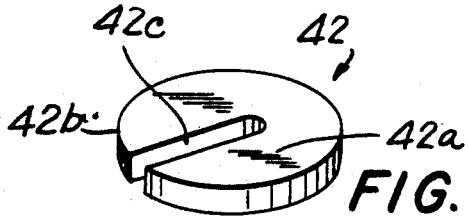
FIG. 6 is a top perspective view of the product release platform

FIG. 6 illustrates a top perspective view of the product release platform 42. Product release platform 42 is a substantially cylindrical disk member having a concavely-curved top surface 42*a* formed with rounded edges 42*b* and having a release platform coin slot 42*c* extending across the disk member. Release platform coin slot 42*c* may be formed to extend partially across product release platform 42 as illustrated in FIG. 6 or alternatively release platform coin slot 42*c* may extend completely across product release platform 42. Product 2 is sequentially disposed on the top surface 42*a* of product release platform 42 as heretofore described. The coin utilized to remove product 2 from product release platform 42 falls into release platform coin slot 42*c* as the product 2 is removed.

Figure 7:
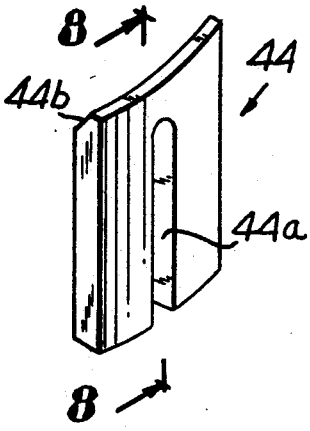
FIG. 7 is an enlarged perspective view of the operating coin guide.
Figure 8:
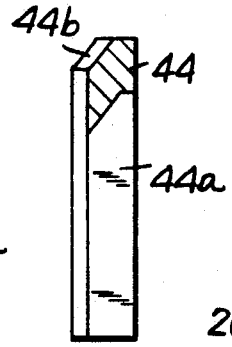
FIG. 8 is a cross-sectional view of the operating coin guide taken along line 8—8 in FIG. 7.
Figure 9:
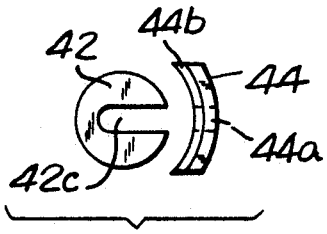
FIG. 9 is a top plan view of the operating coin guide and the product release platform

Referring again to FIG. 2 it can be seen that an operating coin guide 44 is disposed to the fore of product release platform 42. Operating coin guide 44 functions in conjunction with product release platform 42 to direct a coin through a coin collecting guide 34 disposed below product release platform 42 to a coin box 60. An enlarged perspective view of operating coin guide 44 is illustrated in FIG. 7. Operating coin guide 44 is substantially an elongated, laterally-curved member having a vertically-extending guide slot 44*a* formed therein. Guide slot 44*a* is preferably angled away product release platform 42 at a top portion thereof (FIG. 8) to prevent a coin from passing the product 2 disposed on product release platform 42, or should a coin pass the product 2, to prevent the coin from dropping out of the product storage tube 40. Operating coin guide 44 is also formed having a downwardly-angled inwardly-disposed top edge 44*b* to facilitate the passage of product 2 as it moves downward in product storage tube 40. As can be seen in the top plan view of the operating coin guide 44 and the product release platform 42 illustrated in FIG. 9, the guide slot 44*a* and the release platform coin slot 42*c* are longitudinally aligned.

Figure 10:
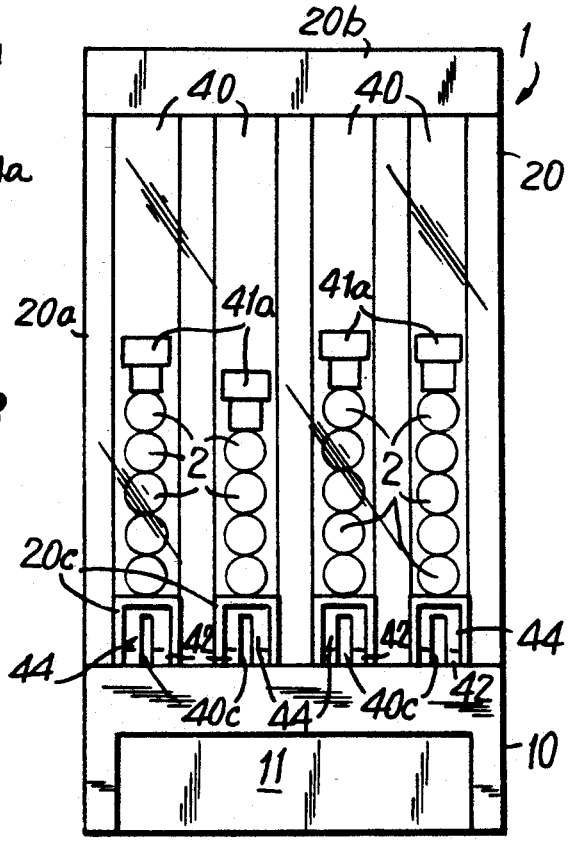
FIG. 10 is a front plan view of the vending machine of the present invention, shown with the coin mechanisms removed.

FIG. 10 illustrates a front plan view of the mechanical vending machine 1 of the present invention having the coin mechanisms 30 removed. The transparent forward wall 20*a* of product storage column 20 is formed having respective cut-away portions 20*c* at the lower end thereof corresponding to the respective coin mechanisms 30. As should be understood from the foregoing and referring to FIG. 2, a coin inserted through tube coin slot 40c (FIG. 4) proceeds through operating coin guide 44 to push product 2 disposed on product release platform 42 from the product storage tube 40 to the storage column opening 12 and thus to the slide platform 50. Slide platform 50 directs product 2 to the product dispensing opening 11 where it can be retrieved by the purchaser. When the coin crosses product release platform 42 to move the product 2 from the product storage tube 40, the coin falls into the release platform coin slot 42c and through collecting coin guide 34 to the coin box 60. The respective coin mechanisms 30 provide means for insertion of a coin through tube coin slot 40c to perform these described operations.

FIGS. 11-14 illustrate a coin mechanism 30 constructed in accordance with the teachings of the present invention and its cooperation with the product storage tube 40. The relative dimensions of the several components of the coin mechanism 30 and product storage column 40 are not drawn to scale for clarity of illustration. The components, however, are sufficiently close together to function as hereinafter described, the pertinent dimensioning being a matter of design choice based on the coin to be utilized.

Figure 12:
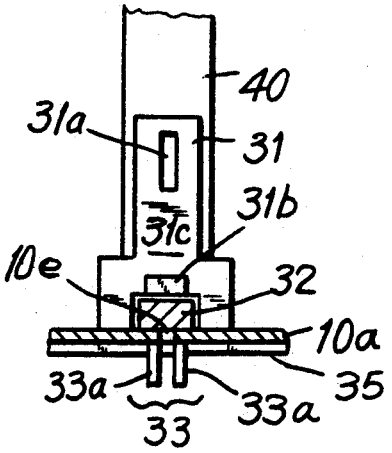
FIG. 12 is a cross-sectional view taken along line 12—12 of FIG. 11.
Figure 13:
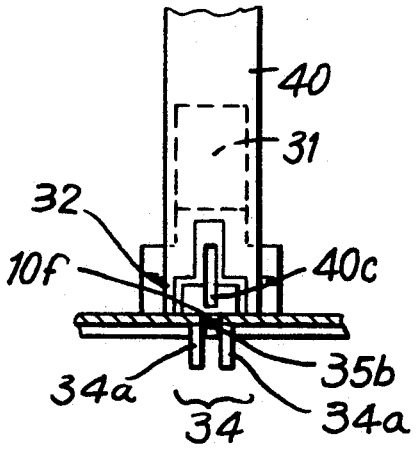
FIG. 13 is a cross-sectional view taken along line 13—13 of FIG. 11.

Coin mechanism 30 generally comprises a coin insert housing 31, a coin insert handle 32 slidably communicating with the coin insert housing 31 and disposed on the top wall 10a of the product dispensing body 10, a coin positioning guide 33, a coin collecting guide 34, each respectively disposed below the top wall 10a of the product dispensing body 10, and a coin bridge 35 disposed between the coin positioning guide 33 and the coin collecting guide 34. Coin insert housing 31 includes a vertically-extending coin insert slot 31a which recieves a coin 3. A coin insert handle forward stop 31b is fixedly attached to a forward face 31c of the coin insert housing 31 to prevent the distal end of coin insert handle 32 from striking the product storage tube 40. A coin insert handle rearward stop 10d is fixedly attached to the top wall 10a of the product dispensing body 10 at the forward edge thereof to prevent removal of coin insert handle 32 from the coin insert housing 31. Forward and rearward plan end views of the coin mechanism 30 are illustrated in FIGS. 12 and 13.

Figure 11:
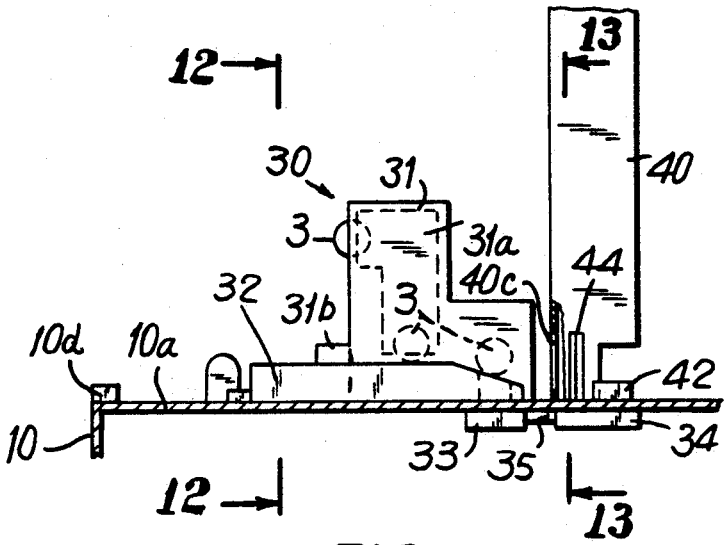
FIG. 11 is an enlarged, partially fragmented side plan view of the coin mechanism.
Figure 14:
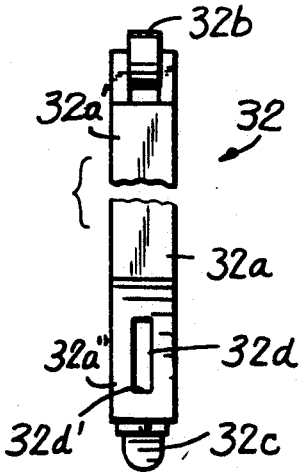
FIG. 14 is a partially fragmented top plan view of the coin insert handle.
Figure 15:
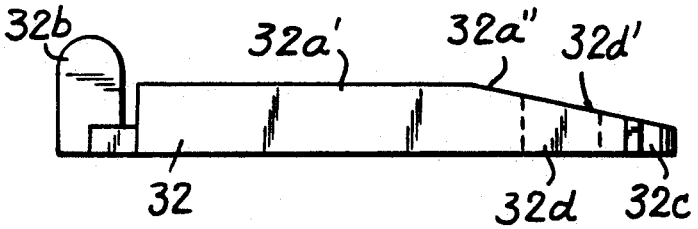
FIG. 15 is a side plan view of the coin insert handle.
Figure 16:
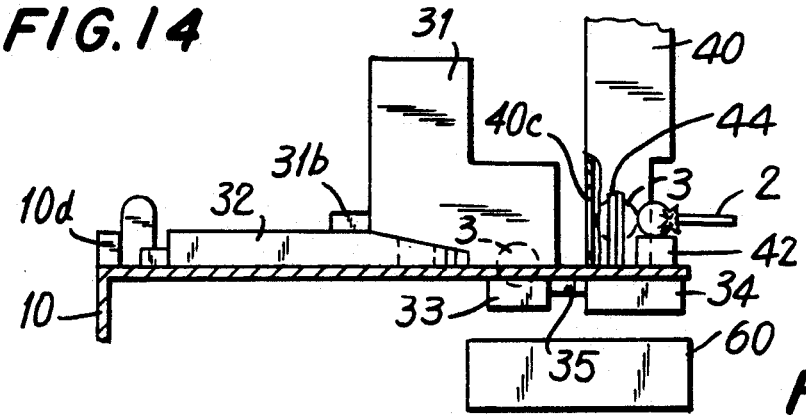
FIG. 16 is a side plan view of the vending machine of the present invention similar to the view illustrated in FIG. 11.

A fragmented top plan view of the coin insert handle 32 is illustrated in FIG. 14. Coin insert handle 32 substantially comprises a longitudinal bar member 32a having a handle knob 32b fixedly attached at one end of the bar member 32a and a handle nose 32c fixedly attached at the opposite end of the bar member 32a. Bar member 32a is formed having a flat-top forward end 32a' and a downwardly-angled distal end 32". A vertically-extending coin positioning slot 32d is formed in the distal end 32a" of the bar member 32a which is sufficiently long to catch the appropriate coin 3 for operation of the coin mechanism 30 without permitting the coin 3 to pass through coin positioning slot 32d, i.e. the length of coin positioning slot 32d is approximately the same but less than the diameter of the coin 3. As can be best seen in the side plan view of the coin insert handle 32 illustrated in FIG. 15 the distal edge 32d' of the coin positioning slot 32d is preferably rounded to facilitate disengagement of coin 3 from coin positioning slot 32d as hereinafter described. When coin insert handle 32 is forwardly disposed as shown in FIG. 11, the coin 3 inserted into coin insert slot 31a falls to coin insert handle 32 and engages the coin positioning slot 32d. If a coin having a smaller diameter than the appropriate coin 3 for operation of the coin mechanism 30 is inserted into coin insert housing 31, such inappropriate coin would simply pass through coin positioning slot 32d and through coin positioning guide 33 to the coin box 60 (FIG. 2). Coin insert handle 32 is slid against the rearward stop 10d to disengage coin 3 from the coin positioning slot 32d causing coin 3 to fall to coin positioning guide 33. As can be seen in FIG. 12, coin positioning guide 33 comprises two substantially first rectangular-cross-sectioned members 33a disposed in displaced parallel relationship to each side of a first top wall opening 10e. In a manner similar to coin positioning slot 32d, first opening 10e defined by the first members 33a of coin positioning guide 33 has a length approximate but less than the diameter of coin 3. Thus, coin 3 engages the first opening 10e when coin insert handle 32 is moved toward the rearward stop 10d (FIG. 16). Coin 3 is now positioned to be pushed toward product storage tube 40 by the nose 32c of coin insert handle 32. When coin insert handle 32 is moved to push coin 3, coin 3 is directed across coin bridge 35 through tube coin slot 40c and operating coin guide 44 to bearing engagement with product 2 disposed on product release platform 42. Further movement of coin insert handle 32 pushes product 2 from the product release platform 42 permitting coin 3 to fall through release platform coin slot 42c and through coin collecting guide 34 to coin box 60. As can be seen in FIG. 13, coin collecting guide 34 comprises two substantially second rectangular-cross-sectioned members 34a disposed in displaced parallel relationship to each side of a second top wall opening 10f. Second opening 10f defined by the second members 34a has a length sufficiently to allow coin to pass therethrough.

The coin bridge 35 is an important component of coin mechanism 30 for proper positioning of a coin 3 against the product 2. If coin 3 bears against product 2 below its longitudinal axis, product 2 may not be fully released from product release platform 42 before coin 3 falls into release platform coin slot 42c. Coin bridge 35 raises coin 3 as it moves toward product 2 to substantially position the medial line of coin 3 above the longitudinal axis of product 2 thereby facilitating the continued bearing engagement of coin 3 to product 2 as coin 3 falls into the release platform coin slot 42c. Thus coin 3 is retained in bearing contact with product 2 for a longer period of time and through a greater longitudinal displacement of product 2 to assure full release of product 2 from the product release platform 42 to the product dispensing body 10.

A top perspective view of coin bridge 35 is illustrated in FIG. 17. Coin bridge 35 generally comprises a bridge bar member 35a having a plurality of raised and laterally-extending protrusions 35b integrally formed on the top portion of bridge bar member 35a in displaced relationship along its length. The protrusions 35b correspond in number 40 to the coin mechanisms 30. Protrusions 35b extend vertically to a height marginally below the top wall 10a of product dispensing body 10. As can be seen in the cross-sectional view of coin bridge 35 illustrated in FIG. 18 protrusion 35b is formed having a rounded proximal top edge 35b', a flat top surface 35b", and optionally a rounded laterally-extending top edge 35c'. The rounded proximal top edge 35b' facilitates rolling of coin 3 from the first opening 10e across coin bridge 35. As illustrated in FIG. 19 the laterally-extending portion 35c of protrusion 35b extends through operating coin guide 44 proximate to product release platform 42 thereby facilitating unimpeded travel of coin 3 from the coin bridge 35*b* to the product release platform 42.

FIG. 20 illustrates a top plan view of coin box 60. Coin box 60 is substantially a rectangular box having a plurality of coin box slots 61 formed in the top portion 60*a* of coin box 60. The number of coin box slots 61 correspond in number to the coin collecting guides 34 and are disposed below the respective coin collecting guides 34. As can be seen in the cross-sectional view of coin box 60 taken along line 21—21 of FIG. 20 coin box slot braces 62 are disposed to each side of the respective coin box slots 61 which serve to prevent unauthorized removal of coins 3 from the coin box 60. Coin box 60 further includes a sliding coin box closure plate 63 which engages respective coin box closure slots 60*b*. Coin box closure plate 63 is selectively lockable by any suitable locking means known in the art.

Figure 22:
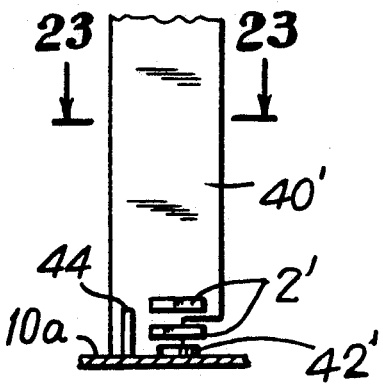
FIG. 22 is a side plan view of an alternative embodiment of the product storage tube.
Figure 23:
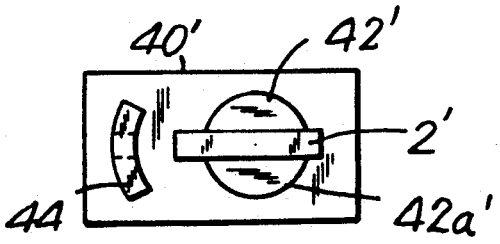
FIG. 23 is a cross-sectional view taken along line 23—23 of FIG. 22.

FIGS. 22 and 23 illustrate a second alternative embodiment of the product storage tube 40' suitable for dispensation of a second product 2' having a rectangular cross-section. Second product storage tube 40 is formed having a rectangular vertical cross-section (FIG. 23). A second product release platform 42' suitable for use with the second product 2' can be formed having a flat top surface 42*a*'. In all other respects the vending machine 1 operates as heretofore described.

Figure 24:
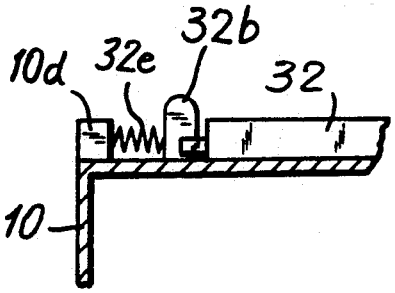
FIG. 24 is a partially fragmented side plan view of an alternative embodiment of the coin insert handle.

In the fragmented side plan view of the coin insert handle 32 illustrated in FIG. 24, a handle spring 32*e* is shown attached at one end to handle rearward stop 10*d* and at the opposite end to handle knob 32*b*. The handle spring 32*e* is compression biased to retract the coin insert handle toward handle rearward stop 10*d* when not forced forward by a purchaser.

Figure 25:
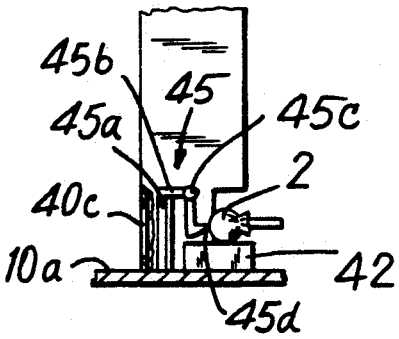
FIG. 25 is a side plan view of a first alternative operating coin guide.
Figure 26:
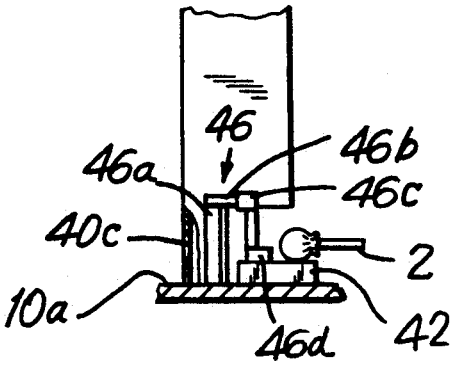
FIG. 26 is a side plan view of a second alternative operating coin guide.

FIGS. 25 and 26 illustrate second and third alternative embodiments of operating coin guide 45 and 46. The second operating coin guide 45 illustrated in FIG. 25 includes an elongated, laterally-curved member 45*a*, as heretofore described, a pivot arm 45*b* extending rearwardly from and fixedly attached to the top wall of the member 45*a*, pivoting means 45*c* attached to the extending end of pivot arm 45*b* and a rotatable shoe 45*d* rotatably attached to the pivoting means 45*c*. As a coin 3 passes through the member 45*a* it engages the rotatable shoe 45*d* causing shoe 45*d* to rotate about pivoting means 45*c* and bear against product 2 disposed on product release platform 42 thereby releasing product 2. The third operating coin guide 46 illustrated in FIG. 26 includes an elongated, laterally-curved member 46*a*, as heretofore described, a sliding arm 46*b* extending rearwardly from and fixedly attached to the top wall of the member 46*a*, an arm sleeve 46*c* slidably attached to arm 46*b* and a bearing shoe 46*d* fixedly attached to sleeve 46*c*. As a coin 3 passes through the member 46*a* it engages the bearing shoe 46*d* causing shoe 46*d* to move forward by means of the sliding engagement of arm 46*b* and sleeve 46*c* and bear against product 2 disposed on product release platform 42 thereby releasing product 2.

The vending machine 1 of the present invention provides novel means in a mechanical vending machine for releasing a stored product 2. For operation of the machine a coin 3 is inserted in the coin insert housing 31 and caused to engage the first opening 10*e* defined by the coin positioning guide 33. The coin 3 is then moved toward the product storage tube 40 by bearing engagement with the coin insert handle 32 causing the coin 3 to cross the coin bridge 35*b*, enter the tube coin slot 40*c*, pass through the operating coin guide 44 and push the product 2 from the product release platform 42. The coin 3 then falls through the release platform slot 42*c* and through the second opening 10*f* defined by the coin collecting guide 34 to the coin box 60.

It is preferred that the all components of the present invention be formed from reinforced plastic or metal. Various changes and modifications can be made to the preferred embodiments of the present invention heretofore described and shown without departing from the spirit and scope of the disclosure. For example, the coin mechanism 30 can be designed to operate using several coins instead of a single coin 3. Such changes and modifications within a fair reading of the following claims are intended as part of this disclosure.

Therefore, in view of the foregoing, I claim:

1. A coin mechanism for a mechanical vending machine comprising a coin insert housing having a coin insert slot for receipt of a coin, said coin insert slot communicating with a coin insert handle;

said coin insert handle slidably communicating with the coin insert housing, said coin insert handle comprising a longitudinal bar member having a handle knob fixedly attached at one end of the bar member and a handle nose fixedly attached at the opposite end of bar member, said bar member being formed having a flat-top forward end and a downwardly-angled distal end, a vertically-extending coin positioning slot being formed in the distal end of the bar member of sufficient length to retain the coin therein;

a coin positioning guide disposed below said coin insert housing;

a coin collecting guide disposed in displaced alignment with said coin positioning guide; and a coin bridge disposed between said coin positioning guide and said coin collecting guide, said coin bridge comprising a bridge bar member having at least one raised and laterally-extending protrusion integrally formed on the top portion of bridge bar member, the coin being receivable in said coin insert housing and retainable in said coin positioning guide, said coin being movable from said coin positioning guide across said coin bridge to said coin collecting guide by bearing engagement of the distal end of said coin insert handle, said coin being thereafter receivable in said coin collecting guide.

2. A coin mechanism as in claim 1 wherein said protrusion is formed having a rounded proximal top edge and a flat top surface.

3. A mechanical vending machine comprising a product dispensing body;

a product storage column disposed on a rearward portion of a top wall of the product dispensing body;

an operating coin guide disposed in said product storage column;

a product releast platform disposed in said product storage column;

a product dispensing slide platform disposed in the product dispensing body;

at least one coin mechanism, said coin mechansim comprising (a) a coin insert housing having a coin insert slot for receipt of a coin, said coin insert slot communicating with a coin insert handle, (b) said coin insert handle slidably communicating with the coin insert housing, said coin insert handle comprising a longitudinal bar member having a handle knob fixedly attached at one end of the bar member and a handle nose fixedly attached at the opposite end of bar member, said bar member being formed having a flat-top forward end and a downwardly-angled distal end, a vertically-extending coin positioning slot being formed in the distal end of the bar member of sufficient length to retain the coin therein, (c) a coin positioning guide disposed below said coin insert housing, (d) a coin collecting guide disposed in displaced alignment with said coin positioning guide, and (e) a coin bridge disposed between said coin positioning guide and said coin collecting guide, said coin bridge comprising a bridge bar member having at least one raised and laterally-extending protrusion integrally formed on the top portion of bridge bar member, said protrusion being formed having a rounded proximal top edge and a flat top surface; and a coin box communicating with the coin mechanism.

4. A mechanical vending machine as in claim 3 wherein said product storage column includes at least one storage tube corresponding in number with the coin mechanism and communicating with said coin mechanism, said product storage tube including a tube slit formed in a rearward portion thereof and extending to a tube product opening.

5. A mechanical vending machine as in claim 4 further including product depression means.

6. A mechanical vending machine as in claim 5 further including a handle spring attached at one end to a handle rearward stop and at the opposite end to a handle knob of said coin insert handle.

7. A mechanical vending machine as in claim 6 wherein said operating coin guide includes an elongated, laterally-curved member, a pivot arm extending rearwardly from and fixedly attached to a top wall of the laterally-curved member, pivoting means attached to an extending end of said pivot arm, and a rotatable shoe rotatably attached to the pivoting means.

8. A mechanical vending machine as in claim 6 wherein said operating coin guide includes an elongated, laterally-curved member, a sliding arm extending rearwardly from and fixedly attached to a top wall of the laterlly-curved member, an arm sleeve slidably attached to arm, and a bearing shoe fixedly attached to sleeve.

* * * * *